US010337793B2

(12) United States Patent
Chou

(10) Patent No.: US 10,337,793 B2
(45) **Date of Patent: *Jul. 2, 2019**

(54) SYSTEM AND METHODS INVOLVING FABRICATING SHEET PRODUCTS

(71) Applicant: GPCP IP Holdings LLC, Atlanta, GA (US)

(72) Inventor: Hung Liang Chou, Neenah, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 116 days.

This patent is subject to a terminal disclaimer.

(21) Appl. No.: 15/582,869

(22) Filed: May 1, 2017

(65) Prior Publication Data

US 2017/0234617 A1 Aug. 17, 2017

Related U.S. Application Data

(63) Continuation of application No. 13/359,844, filed on Jan. 27, 2012, now Pat. No. 9,670,617.

(Continued)

(51) Int. Cl.
*F26B 3/347* (2006.01)
*D21F 11/00* (2006.01)

(Continued)

(52) U.S. Cl.
CPC ..... *F26B 3/347* (2013.01); *B65H 20/02* (2013.01); *D21F 3/0272* (2013.01);

(Continued)

(58) Field of Classification Search
None
See application file for complete search history.

(56) References Cited

U.S. PATENT DOCUMENTS 2,221,200 A 11/1940 Perry
2,668,786 A 2/1954 Perry (Continued)

FOREIGN PATENT DOCUMENTS

JP S62201760 A 9/1987
JP H04506839 A 11/1992

(Continued)

OTHER PUBLICATIONS

Communication pursuant to Article 94(3) EPC dated Jul. 18, 2017, in corresponding European Patent Application No. 12 746 8381-1710.

(Continued)

*Primary Examiner* — Dennis R Cordray
(74) *Attorney, Agent, or Firm* — Laura L. Bozek

(57) ABSTRACT

A system for fabricating a sheet product. A first rotatable roller includes a rotatable drum portion having an outer surface that rotates about a rotational axis in a first direction and conveys a sheet product. The rotatable drum portion also has a plurality of ports communicative between an inner surface and an outer surface. The ports extend along and around the drum portion. The first rotatable roller emits a pressurized fluid. A second rotatable roller has an outer surface arranged proximate to the outer surface of the rotatable drum portion of the first rotatable roller, and a heat source portion to heat the second rotatable roller to dry the sheet product. The second rotatable roller rotates in a second direction that is opposite to the first direction. A gap is defined between the second rotatable roller and the first rotatable roller through which the sheet product passes.

20 Claims, 8 Drawing Sheets

Related U.S. Application Data

(60) Provisional application No. 61/443,013, filed on Feb. 15, 2011.

(51) Int. Cl.

| | |
|---|---|
| ***B65H 20/02*** | (2006.01) |
| ***D21F 3/02*** | (2006.01) |
| ***D21F 11/14*** | (2006.01) |
| ***F26B 13/16*** | (2006.01) |

(52) U.S. Cl.

CPC ..... *D21F 3/0281* (2013.01); *D21F 11/00* (2013.01); *D21F 11/006* (2013.01); *D21F 11/14* (2013.01); *F26B 13/16* (2013.01); *B65H 2301/31122* (2013.01); *B65H 2301/5143* (2013.01); *B65H 2406/10* (2013.01); *B65H 2406/15* (2013.01); *B65H 2801/84* (2013.01)

(56) References Cited

U.S. PATENT DOCUMENTS

| | | | |
|---|---|---|---|
| 3,351,521 | A | 11/1967 | Murray et al. |
| 3,640,000 | A | 2/1972 | Lee et al. |
| 3,839,146 | A | 10/1974 | Fleissner |
| RE28,459 | E | 7/1975 | Cole et al. |
| 3,981,084 | A | 9/1976 | Sobota |
| 4,306,934 | A | 12/1981 | Seppanen |
| 4,324,613 | A | 4/1982 | Wahren |
| 5,127,168 | A | 7/1992 | Pikulik |
| 5,232,555 | A | 8/1993 | Daunais et al. |
| 5,569,359 | A | 10/1996 | Joiner |
| 5,588,223 | A | 12/1996 | Marshall |
| 5,635,030 | A | 6/1997 | Meschenmoser |
| 6,077,398 | A | 6/2000 | Fiscus et al. |
| 6,361,654 | B1 | 3/2002 | Chuang et al. |
| 6,395,136 | B1 | 5/2002 | Andersson et al. |
| 6,887,350 | B2 | 5/2005 | Garnier et al. |
| 6,921,460 | B2 | 7/2005 | Hermans et al. |
| 6,991,707 | B2 | 1/2006 | Hill, Jr. et al. |
| 7,399,378 | B2 | 7/2008 | Edwards et al. |
| 7,578,092 | B2 | 8/2009 | Schmidt et al. |
| 7,718,035 | B2 | 5/2010 | Boettcher et al. |
| 7,721,464 | B2 | 5/2010 | Hada et al. |
| 2004/0173333 | A1 | 9/2004 | Hermans et al. |
| 2004/0238135 | A1 | 12/2004 | Edwards et al. |
| 2005/0072543 | A1 | 4/2005 | Hada et al. |
| 2006/0207736 | A1 | 9/2006 | Boettcher et al. |
| 2008/0280520 | A1 | 11/2008 | Schmidt et al. |

FOREIGN PATENT DOCUMENTS

| | | | |
|---|---|---|---|
| JP | H04363579 | A | 12/1992 |
| JP | 2004-534156 | A | 11/2004 |
| SU | 408977 | A1 | 9/1974 |
| WO | 91/01407 | A1 | 2/1991 |
| WO | 02/099192 | A2 | 12/2002 |
| WO | 2005/035869 | A1 | 4/2005 |

OTHER PUBLICATIONS

International Search Report and Written Opinion dated May 24, 2012, issued in corresponding International Patent Application No. PCT/US2012/023255.

Communication including extended European Search Report dated Jun. 18, 2014, issued in corresponding European Patent Application No. 12746838.7-1710/2675950.

Japanese Official Action dated Aug. 4, 2015, issued in corresponding Japanese Patent Application No. 2013-553460, with an English translation.

Chinese Official Action dated Aug. 14, 2015, issued in corresponding Chinese Patent Application No. 201280007645.7, with an English translation.

Chinese Official Action dated Feb. 22, 2016, issued in corresponding Chinese Patent Application No. 201280007645.7, with an English translation.

Chinese Official Action dated Sep. 12, 2016, issued in corresponding Chinese Patent Application No. 201280007645.7, with an English translation.

English translation of Japanese Notice of Allowance dated Nov. 15, 2016, issued in corresponding Japanese Patent Application No. 2013-553460.

Chinese Rejection Decision dated Jan. 16, 2017, issued in corresponding Chinese Patent Application No. 201280007645.7, with an English translation.

Definition of proximate, The Free Dictionary by Farlex, 3 pages, retrieved Jan. 11, 2019, URL: http://www.thefreedictionary.com/proximate.

Definition of assembly, The Free Dictionary by Farlex, 6 pages, retrieved Jan. 11, 2019, URL: http://www.thefreedictionary.com/assembly.

SYSTEM AND METHODS INVOLVING FABRICATING SHEET PRODUCTS

CLAIM OF PRIORITY

This application is a continuation application of copending U.S. patent application Ser. No. 13/359,844, filed Jan. 27, 2012, which is a non-provisional application based on U.S. Provisional Patent Application No. 61/443,013, filed Feb. 15, 2011. The priority of these applications is hereby claimed and the disclosures thereof are incorporated herein by reference.

BACKGROUND OF THE INVENTION

The subject matter disclosed herein relates to systems and methods for fabricating sheet products.

Sheet products may be fabricated using a variety of methods. In many fabrication methods, the sheet product has a high moisture content (moisture to fiber ratio) in early stages of the process. The sheet product may be dried using a variety of methods to lower the moisture content and increase the tensile strength of the sheet product.

In some fabrication processes, the sheet product may be relatively thin, resulting in a low tensile strength when the moisture content in the sheet product is high. In such processes, a textile backing cloth or fabric having a relatively high tensile strength may be mechanically bonded to or in contact with the moist sheet product. The use of the textile backing cloth contacting the moist sheet product allows the moist sheet product to undergo a variety of mechanical and chemical automated processes that include, for example, exerting tension with rollers or other mechanical devices while avoiding damaging or tearing the moist sheet product.

BRIEF DESCRIPTION OF THE INVENTION

According to one aspect of the invention, a system for fabricating a sheet product includes a first rotatable roller including (a) a rotatable drum portion having (i) a first end and a second end, (ii) an outer surface and an inner surface, the outer surface rotating about a rotational axis in a first direction and configured to convey a sheet product that has a first surface and a second surface, the first surface of the sheet product being in contact with a portion of the outer surface of the rotatable drum portion, the inner surface defining a cavity within the rotatable drum portion, and (iii) a plurality of ports communicative between the inner surface and the outer surface, the plurality of ports extending along the rotatable drum portion, and around the outer surface of the rotatable drum portion, and (b) a fluid emission portion disposed in the cavity, the fluid emission portion having (i) an orifice operative to receive a pressurized fluid from a pressurized fluid source and (ii) a port connected to the orifice and operative to emit the pressurized fluid through the plurality of ports of the rotatable drum portion, the port being arranged as an elongated slot in the fluid emission portion that extends (i) in a direction parallel to the rotational axis of the rotatable drum portion, and (ii) along the rotatable drum portion. A second rotatable roller includes (i) an outer surface arranged proximate to the outer surface of the rotatable drum portion of the first rotatable roller, and (ii) a heat source portion configured to output a pressurized fluid and to heat the second rotatable roller to dry the sheet product, the second rotatable roller being operative to rotate in a second direction that is opposite to the first direction. A gap is defined between the second rotatable roller and the first rotatable roller through which the sheet product is allowed to pass. The port is configured to emit the pressurized fluid (i) as a stream in a region proximate to the gap, (ii) at an angle relative to the second roller, (iii) to impinge on the first surface of the sheet product in the gap, (iv) to separate contact between the outer surface of the first rotatable roller and the sheet product, and (v) to transfer the sheet product from the first rotatable roller to the second rotatable roller, with the second surface of the sheet product being in contact with the outer surface of the second rotatable roller. The first rotatable roller is configured to only emit the pressurized fluid through the plurality of ports extending (i) along the rotatable drum portion, and (ii) around the rotatable drum portion.

According to another aspect of the present invention, a method of fabricating a sheet product includes rotating a rotatable drum portion of a first roller in a first direction about a rotational axis, the rotatable drum portion having (a) a first end and a second end, (b) an outer surface and an inner surface, the inner surface defining a cavity within the rotatable drum portion, and (c) a plurality of ports communicative between the inner surface and the outer surface, the plurality of ports extending along the rotatable drum portion, and around the outer surface of the rotatable drum portion. The method further includes rotating a second roller in a second direction, the second direction being opposite to the first direction, the second roller having an outer surface, conveying a sheet product, the sheet product having a first surface and a second surface, and the sheet product being conveyed with the first surface of the sheet product in contact with a portion of the outer surface of the rotatable drum portion of the first roller, passing the sheet product, through a gap defined between the outer surface of the first roller and the outer surface of the second roller, supplying a pressurized fluid from a pressurized fluid source to a fluid emission portion disposed in the cavity of the first roller, the pressurized fluid being supplied to an orifice of the fluid emission portion, emitting a stream of pressurized fluid from a port of the fluid emission portion of the first roller through the plurality of ports of the rotatable drum portion of the first roller, such that the stream of pressurized fluid (a) is emitted in a region proximate to the gap, (b) is emitted at an angle relative to the second roller, (c) impinges on the first surface of the sheet product in the gap, (d) imparts a force on the sheet product to separate contact of the sheet product from the outer surface of the first roller, and (e) transfers the sheet product from the first roller to the second roller, with the second surface of the sheet product being in contact with the outer surface of the second roller, the port being connected to the orifice and arranged as an elongated slot in the fluid emission portion that extends (i) in a direction parallel to the rotational axis of the rotatable drum portion, and (ii) along the rotatable drum portion, and heating the second roller with a pressurized fluid to dry the sheet product. The first roller is configured to only emit the pressurized fluid through the plurality of ports extending (i) along the rotatable drum portion, and (ii) around the rotatable drum portion.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages, of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Sheet products are often fabricated with systems that include a variety of rollers and drums that move and direct a sheet product through paths of various fabrication stages. The transition of a sheet product from contacting one roller or drum to another through a fabrication path is complicated by, for example, the thickness, moisture content, and tensile strength of the sheet product, each of which may change as the sheet product moves through the fabrication stages. Thus, a method and system that improves the transition of a sheet product from contacting different surfaces in a fabrication path is desired.

The term "sheet products" as used herein is inclusive of natural and/or synthetic cloth or paper sheets. Sheet products may include both woven and non-woven articles. There are a wide variety of nonwoven manufacturing processes and they can be either wetlaid or drylaid. Some examples include hydroentangled (sometimes called spunlace), DRC (double re-creped), airlaid, spunbound, carded, paper towel, and meltblown sheet products. Further, sheet products may contain fibrous cellulosic materials that may be derived from natural sources, such as wood pulp fibers, as well as other fibrous material characterized by having hydroxyl groups attached to the polymer backbone. These include glass fibers and synthetic fibers modified with hydroxyl groups. Examples of sheet products include, but are not limited to, wipers, napkins, tissues, rolls, towels or other fibrous, film, polymer, or filamentary products.

Figure 1A:
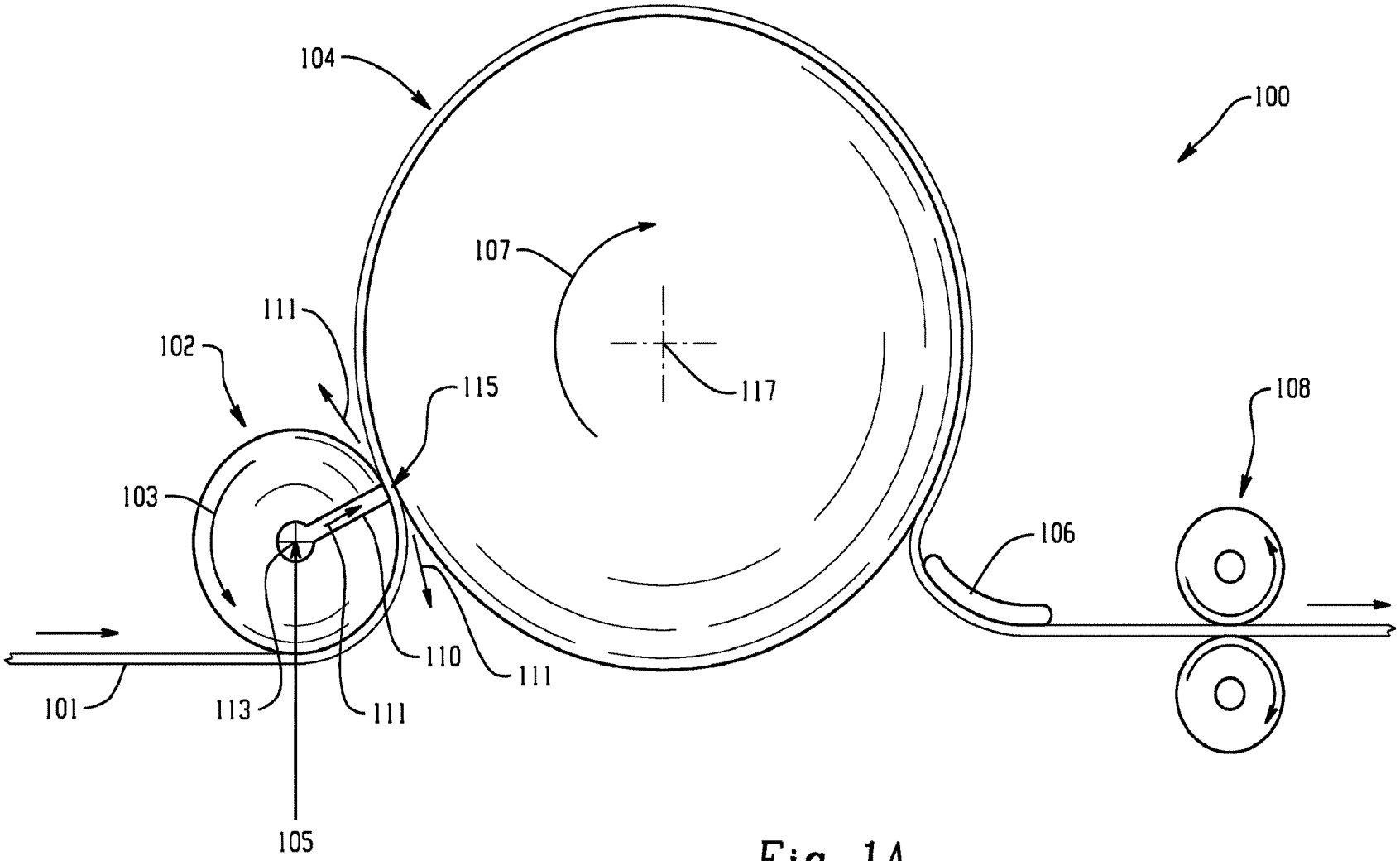
FIG. 1A illustrates a side view of an exemplary embodiment of a system in accordance with an embodiment of the invention.

FIG. 1A illustrates an exemplary embodiment of a system 100. The system 100 may, for example, in some embodiments, be a portion of a sub-system of a larger fabrication system. In this regard, the system 100 includes a first roller assembly 102 (shown partially cut-away) that cooperatively engages a second roller assembly 104, and a pressurized fluid source 105 such as, for example, compressed air, gas, or other type of pressurized fluid. In an embodiment, the system 100 includes a directing assembly 106 and a drive roller assembly 108.

In operation, a sheet product 101 moves as a continuous sheet through the system 100. The sheet product 101 contacts the rotating first roller assembly 102 that rotates about an axis of rotation 113 and passes between a gap 115 defined by the first roller assembly 102 and the second roller assembly 104. The sheet product 101 contacts the rotating second roller assembly 104 that rotates about an axis of rotation 117, and travels in contact with the second roller assembly 104 through the gap 115. In the illustrated embodiment, the first roller assembly 102 and the second roller assembly 104 rotate in opposing directions, as indicated by the arrows 103 and 107. The first roller assembly 102 includes one or more stationary ports 110 communicative with the pressurized fluid source 105. The ports 110 are operative to emit a pressurized fluid indicated by the arrow 111, such as, for example, compressed air, gas, or steam having a flow path indicated by the arrows 111. The pressurized fluid is operative to exert a force on the sheet product 101 that biases the sheet product 101 away from an outer surface of the first roller assembly 102 and towards the outer surface of the second roller assembly 104 in a region proximate to the gap 115 defined by the first roller assembly 102 and the second roller assembly 104.

The gap 115 defined by the first roller assembly 102 and the second roller assembly 104 is sized such that a compressive force may be exerted on the sheet product 101. The compressive force exerted on the sheet product 101 by the first roller assembly 102 and the second roller assembly 104 and the biasing force exerted by the pressurized fluid assist in overcoming mechanical forces such as, for example, surface tension or adhesion between the first roller assembly 102 and the sheet product 101. (Additional forces may be exerted on the sheet product 101 to assist in separating the sheet product 101 from the first roller assembly such as, for example, an adhesive force exerted by the outer surface of the second roller assembly 104 and/or a tensile force exerted on the sheet product 101 by the rotation of the second roller assembly 104.) Once the sheet product 101 is separated from the first roller assembly 102 and contacts the second roller assembly 104, the sheet product 101 rotates about the axis of rotation of the second roller assembly 104. (The second roller assembly 104 may be used, for example, to assist in removing moisture from the sheet product 101.) The directing assembly 106 includes, for example, a metallic strip or other suitable mechanical device that assists in separating the sheet product 101 from contacting the second roller assembly 104. In the illustrated embodiment, the drive roller assembly 108 includes a pair of rollers in contact with the sheet product 101. The drive roller assembly 108 rollers rotate and exert a tensile and compressive force on the sheet product 101 that pulls the sheet product through the drive roller assembly 108.

Figure 1B:
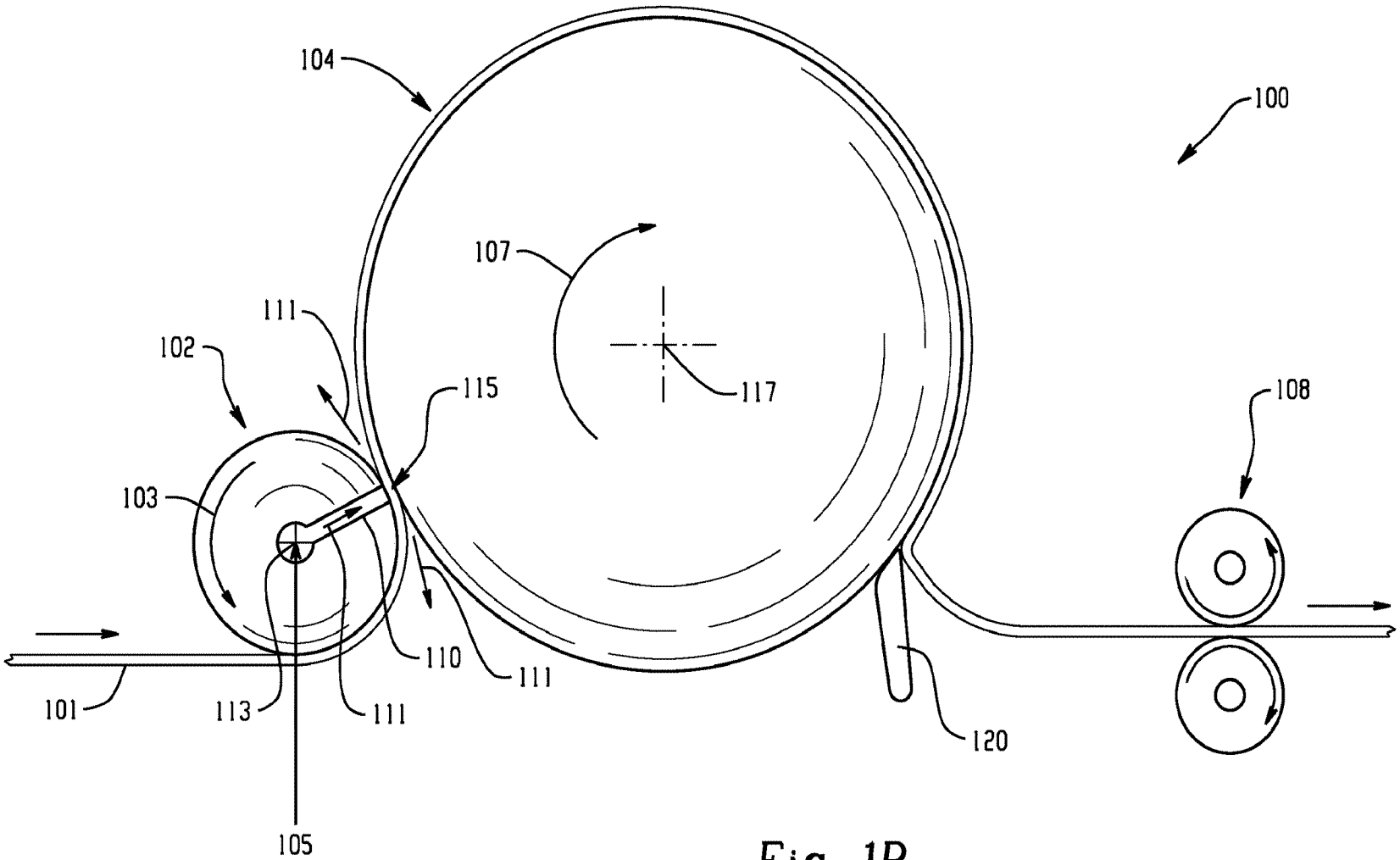
FIG. 1B illustrates a side view of an alternate exemplary embodiment of a system in accordance with an embodiment of the invention.

FIG. 1B illustrates an alternate exemplary embodiment of a system similar to the system 100 (of FIG. 1A) described above. In this regard, the illustrated embodiment includes a blade assembly 120. The blade assembly 120 may be formed from, for example, a metallic, ceramic, or plastic material. In operation, the blade assembly 120 may contact the second roller assembly 104 and exert a force that assists in mechanically releasing the sheet product 101 from the second roller assembly 104.

Figure 2:
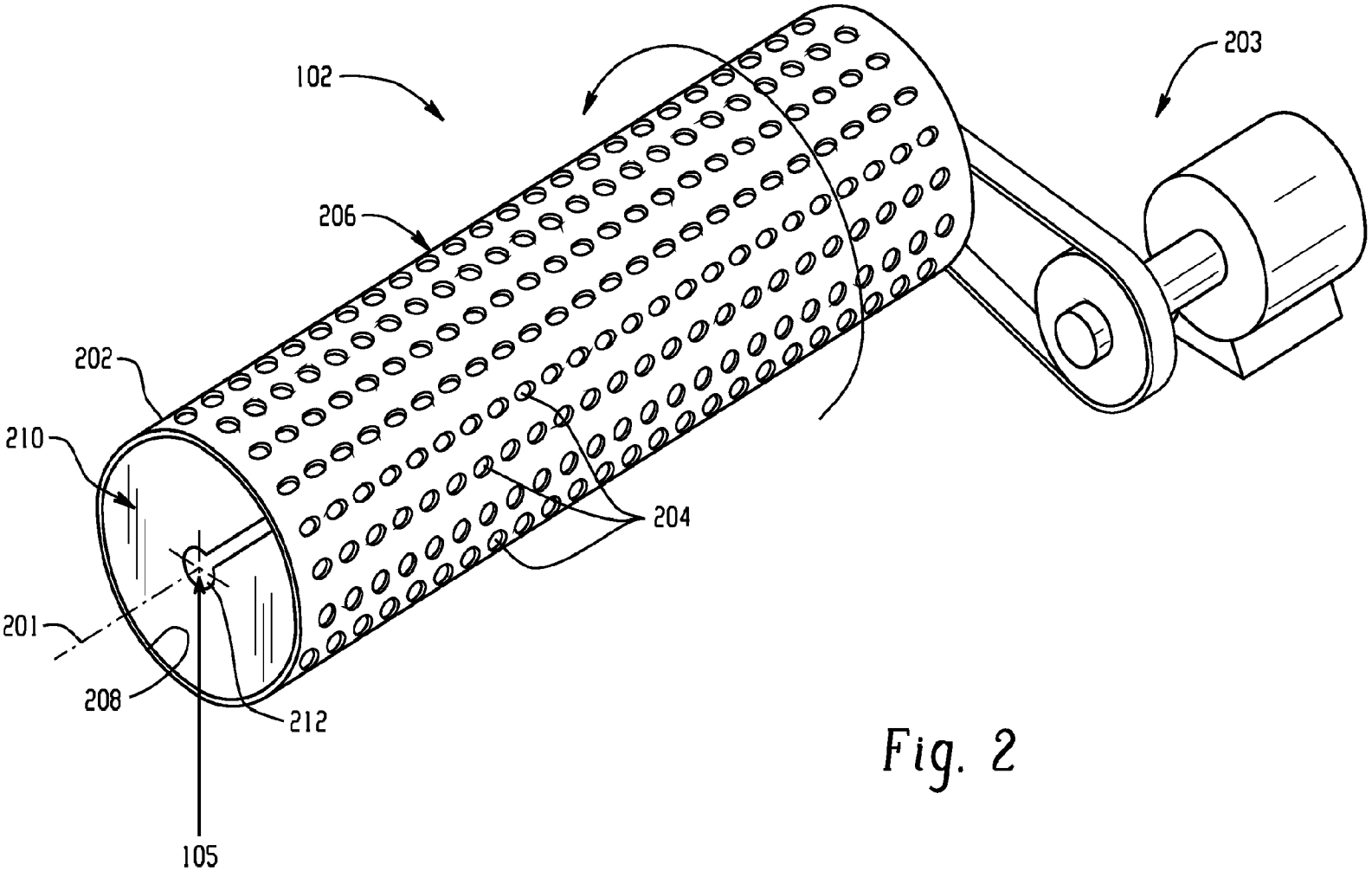
FIG. 2 illustrates a perspective view of a portion of an exemplary embodiment of the first roller assembly of the system of FIG. 1A.

FIG. 2 illustrates a perspective view of a portion of an exemplary embodiment of the first roller assembly 102. The first roller assembly 102 includes a drum portion 202 that, in one embodiment, is tubular in shape and includes a plurality of ports 204 that are communicative with the outer surface 206 of the drum portion 202 and the inner surface 208 of the drum portion 202. In an embodiment, the drum portion 202 is driven to rotate about a rotational axis 201 by, for example, a mechanical linkage and driving assembly 203. The first roller assembly 102 includes a fluid emission portion 210. The fluid emission portion 210 is disposed in an inner cavity partially defined by the inner surface 208 of the drum portion 202 and remains substantially stationary relative to the rotation of the drum portion 202. The fluid emission portion 210 and the drum portion 202 may be mechanically connected by, for example, bearings, bushings, or another similar mechanical arrangement that allows the drum portion 202 to rotate about the fluid emission portion 210. The fluid emission portion 210 includes one or more ports (described below) communicative with an orifice 212, that are operative to receive a pressurized fluid such as, for example, air from the pressurized fluid source 105 and to emit the pressurized fluid from the ports 204 such that the pressurized fluid passes through the plurality of ports 204 in the drum portion 202. The pressurized fluid impinges the sheet product 101 and imparts a force on the sheet product 101 (described above in FIG. 1A). The fluid emission portion 210 emits a stream of pressurized fluid at a constant angle relative to the arrangement of the second roller assembly 104.

Figure 3:
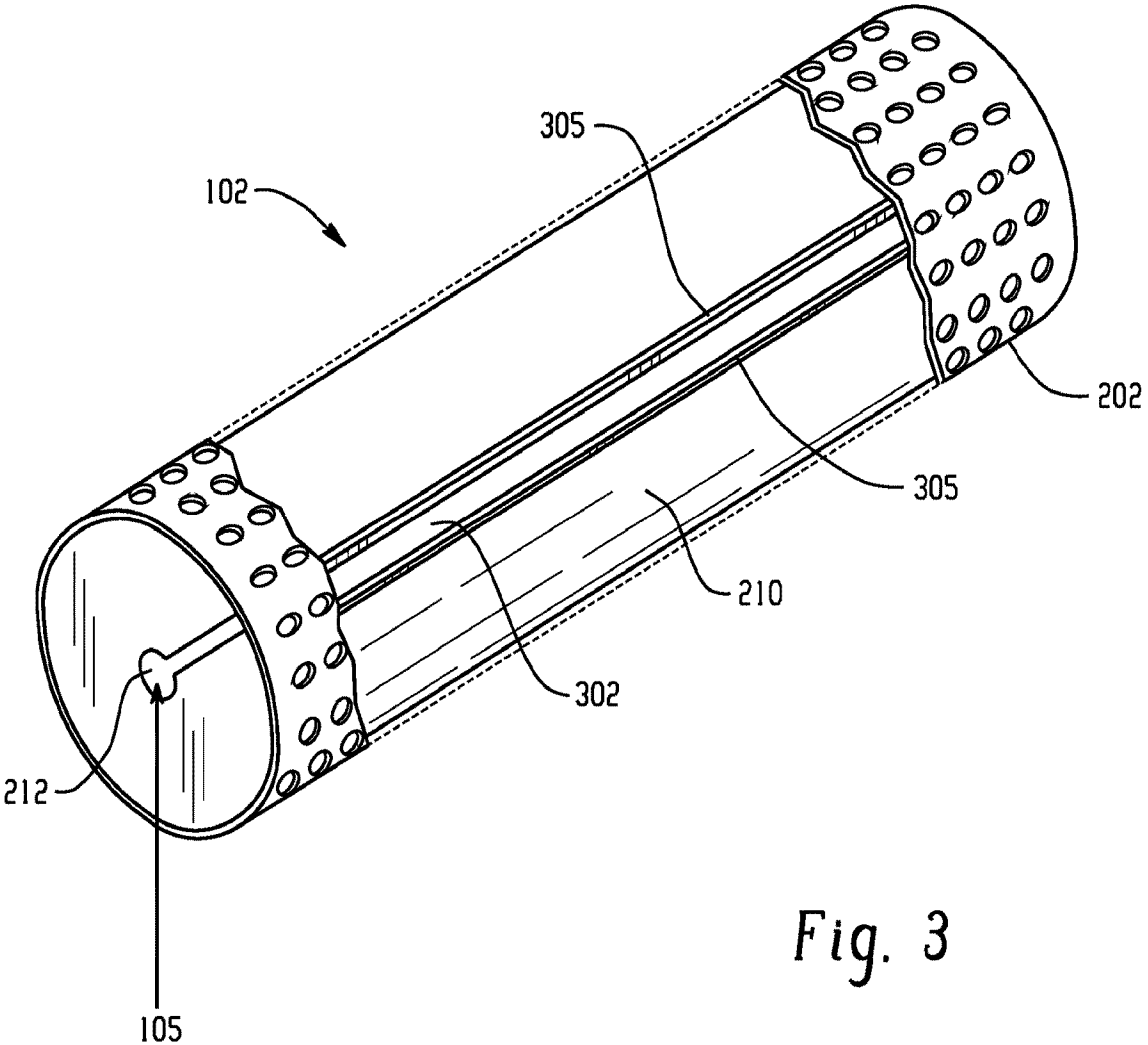
FIG. 3 illustrates a perspective, partially cut-away view of an exemplary embodiment of the first roller assembly of FIG. 2.

FIG. 3 illustrates a perspective, partially cut-away view of an exemplary embodiment of the first roller assembly 102. The fluid emission portion 210 includes a port 302 that is communicative with the orifice 212 and the pressurized fluid source 105. The port 302 may be similar to the port 110 (of FIG. 1A) described above. A seal 305 may be arranged proximate to the orifice 212 that is operative to direct the emitted fluid in a flow path that impinges a portion of the drum portion 202. The seal 305 may contact the inner surface of the drum portion 202 and may include, for example, a ceramic, metallic, or flexible plastic material.

Figure 4:
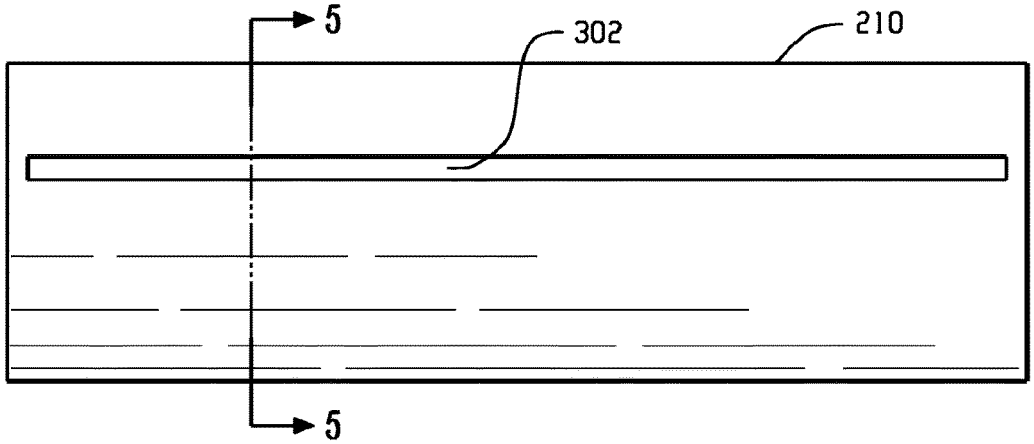
FIG. 4 illustrates a front view of the fluid emission portion of the first roller assembly of FIG. 2.
Figure 5:
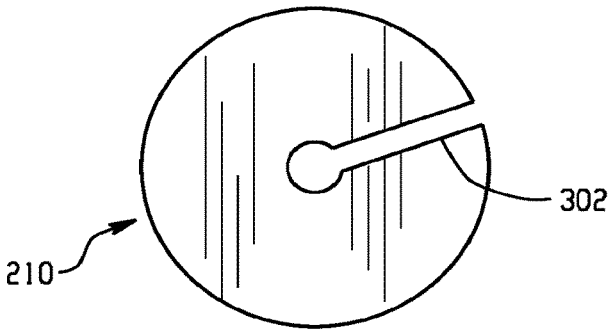
FIG. 5 illustrates a cross-sectional view of the fluid emission portion taken along the line 5-5 of FIG. 4.

FIG. 4 illustrates a front view of the fluid emission portion 210. The illustrated embodiment includes the port 302 arranged as a slot or channel in the fluid emission portion 210. FIG. 5 illustrates a cross-sectional view of the fluid emission portion 210 taken along the line 5-5 of FIG. 4.

Figure 6:
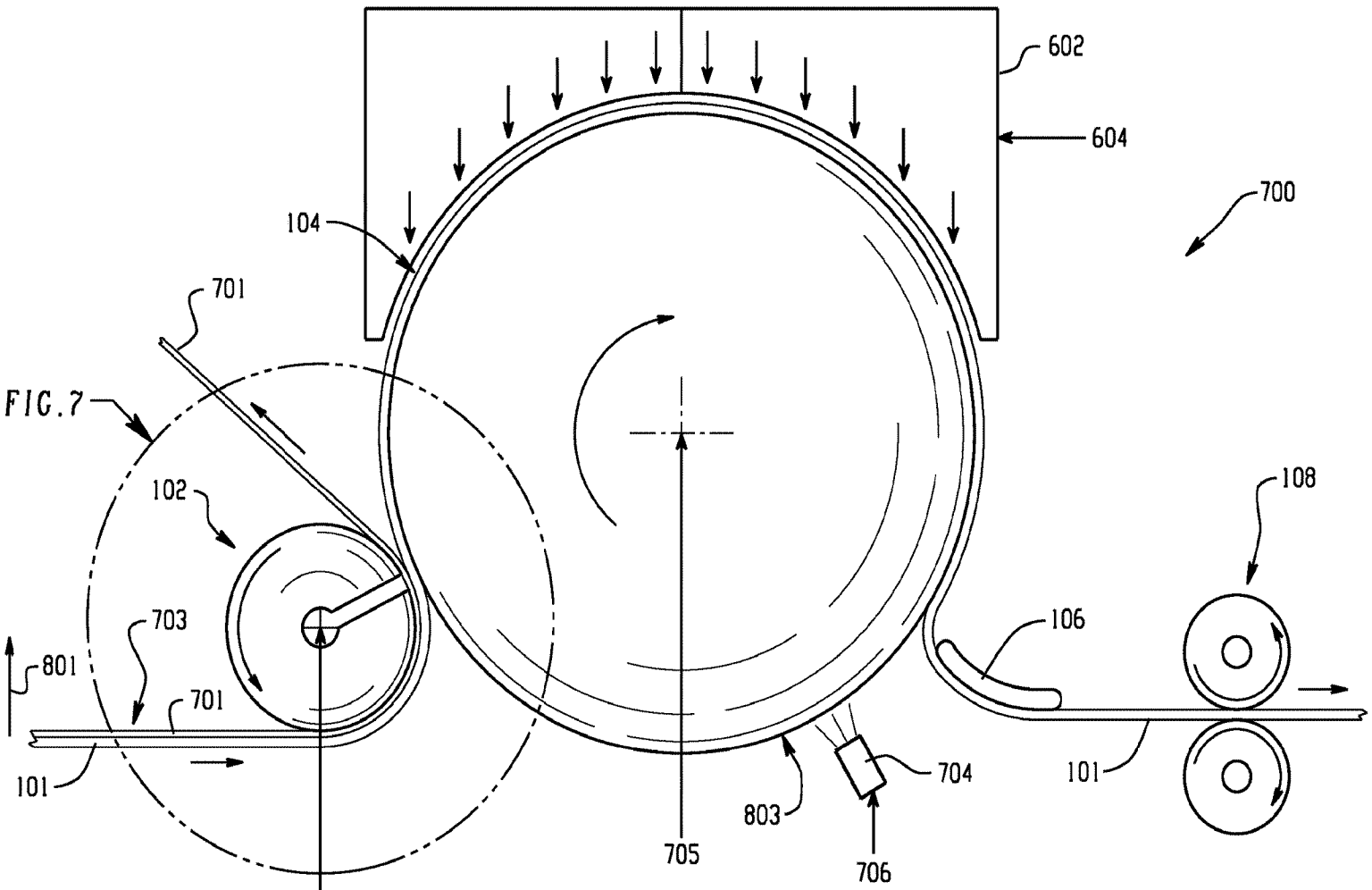
FIG. 6 illustrates an alternate exemplary embodiment of a system.

FIG. 6 illustrates an alternate exemplary embodiment of a system 700. The system 700 includes a first roller assembly 102 (shown partially cut-away) and a second roller assembly 104. The sheet product 101 is attached (or, in contact with) a fabric 701 (the sheet product 101 attached (or in contact with) the fabric 701 may each collectively or individually define a sheet material 703), which acts as a relatively high tensile strength backing for the sheet product 101.

Figure 7:
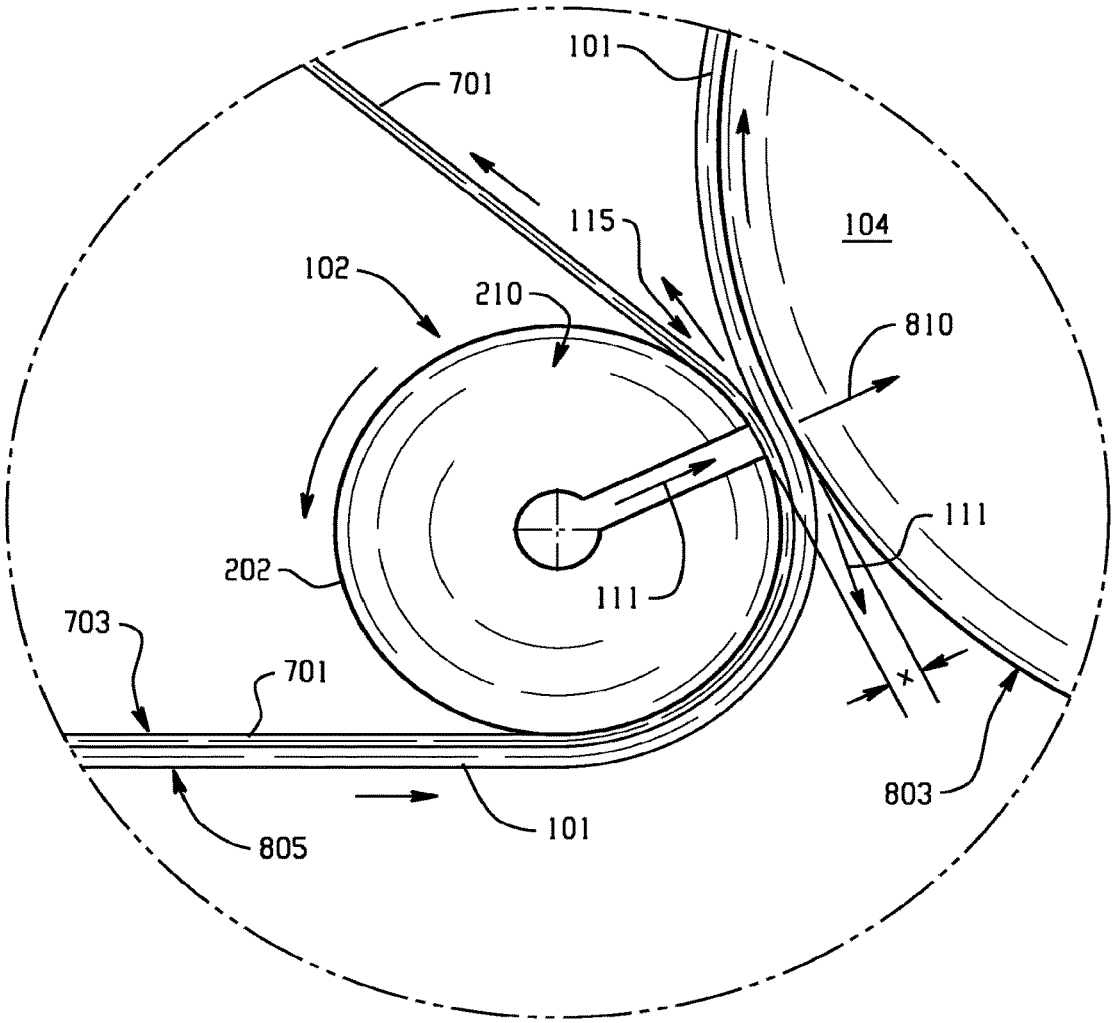
FIG. 7 illustrates a detailed view of an exemplary arrangement of the sheet product and the fabric shown in FIG. 6.

FIG. 7 illustrates an exemplary embodiment of the arrangement of the sheet product 101 and the fabric 701. The fabric 701 includes, for example, a woven or mesh textile material having a porosity sufficient to allow at least a portion of the pressurized air to permeate through the fabric 701. The fabric 701 is shown for illustrative purposes as having a uniform profile. Alternate embodiments of the fabric 701 may include, for example, a fabric 701 having an undulating or contoured surface that contacts the sheet product 101. The contoured surface of the fabric 701 may be used to form a sheet product 101 having a textured surface or profile. Referring back to FIG. 6, the system 700 may include an adhesive spray assembly 704 that receives pressurized liquid adhesive from an adhesive source 706. In operation, the fabric 701 and the sheet product 101 travel in continuous sheets through the system 700. The system 700 is operative to separate the fabric 701 from the sheet product 101 and to remove moisture from the sheet product 101. In this regard, the adhesive spray assembly 704 sprays an adhesive on an outer surface 803 of the second roller assembly 104 that forms a tacky adhesive film on the second roller assembly 104. The second roller assembly 104 may be heated by, for example, a heat source or element 705 that may include steam, heated gas, convective, or microwave arrangements. The heated second roller assembly 104 is operative to remove moisture from the sheet product 101 as the sheet product 101 rotates with the second roller assembly 104. A hood portion 602 may be arranged over the second roller assembly 104. The hood portion 602 may receive hot gas such as, for example, air from a heat source 604. The hot gas is operative to heat the sheet product 101.

Referring to FIG. 7, as the drum portion 202 of the first roller assembly 102 rotates, a surface of the fabric 701 contacts the first roller assembly 102. The rotation of the drum portion 202 draws the fabric 701 and the sheet product 101 into the gap 115 having a width (x) defined by the drum portion 202 and the second roller assembly 104. The surface 805 of the sheet product 101 contacts the outer surface 803 of the second roller assembly 105. The drum portion 202 and the second roller assembly 104 exert a compressive force on the sheet product 101. Pressurized fluid having a flow path indicated by the arrows 111 is emitted from the port(s) 302 (FIG. 3) of the fluid emission portion 210. The pressurized fluid passes through the fabric 701 and impinges on the sheet product 101 exerting a force on the sheet product 101 in the direction of the arrow 810 towards the second roller assembly 104 that assists in separating the fabric 701 from the sheet product 101. The fabric 701 is pulled at an angle away from the sheet product 101 by the rotation of the drum portion 202 while the force exerted by the rotation of the second roller assembly 104 assists in the separation of the sheet product 101 from the fabric 701.

As described above, a number of forces are used to separate the fabric 701 from the sheet product 101 and to assist in the adherence of the sheet product to the second roller assembly 104. A mechanical force is exerted by the arrangement of the fabric 701 that draws the fabric 701 away from the sheet product 101 as the drum portion 202 rotates. The compressive force exerted by the drum portion 202 and the second roller assembly 104 on the sheet product 101 facilitates the adhesion of the sheet product 101 to the outer surface 803 of the second roller assembly 104. The adhesive film applied to the outer surface 803 of the second roller assembly 104 assists in maintaining contact between the sheet product 101 and the second roller assembly 104. The pressurized air, emitted from the fluid emission portion 201, passing through the fabric 701, and impinging on the sheet product 101, further assists in adhering the sheet product 101 to the second roller assembly 104. The force of the pressurized air increases the force exerted in the direction of the arrow 801 and allows for compactively less adhesive and/or surface area to be applied to the outer surface 803 of the second roller assembly 104. Following the adhesion of the sheet product 101 to the second roller assembly 104, moisture may be removed from the sheet product 101 by, for example, heating the second roller assembly 104, resulting in a reduction in the moisture content of the sheet product 101. The sheet product 101 is separated from the second roller assembly 104 following the drying process and may enter subsequent fabrications processes such as, for example, additional drying processes, texturizing processes, and eventual packaging processes.

Figure 8:
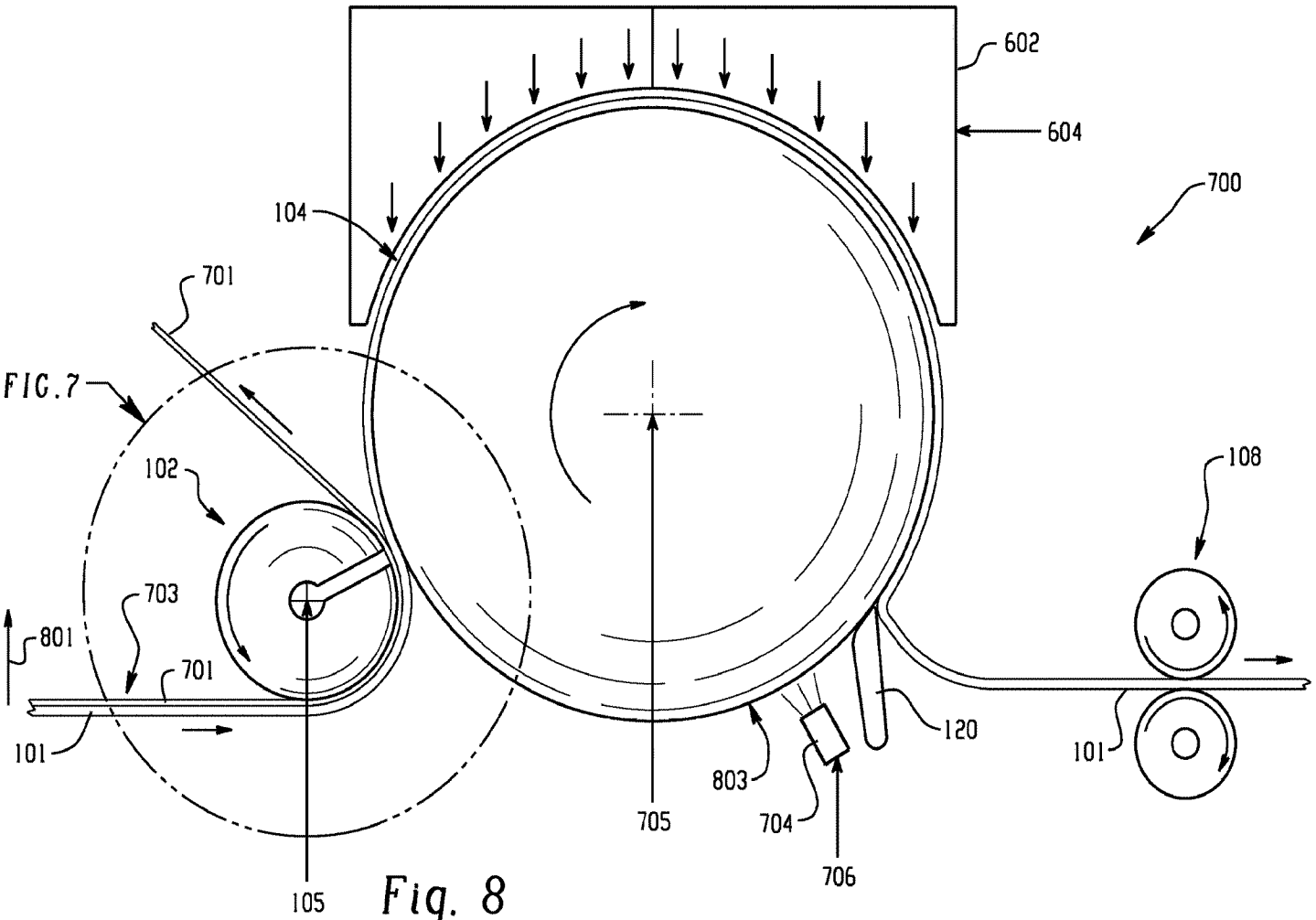
FIG. 8 illustrates another alternate exemplary embodiment of a system.

FIG. 8 illustrates an alternate embodiment of a system similar to the illustrated embodiment of FIG. 6 described above. (The illustrated embodiment includes a blade assembly 120 similar to the blade assembly described above in FIG. 1B.)

While the invention has been described in detail in connection with only a limited number of embodiments, it should be readily understood that the invention is not limited to such disclosed embodiments. Rather, the invention can be modified to incorporate any number of variations, alterations, substitutions, or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

I claim:

1. A system for fabricating a sheet product, the system comprising:

(A) a first rotatable roller including:

(a) a rotatable drum portion having (i) a first end and a second end, (ii) an outer surface and an inner surface, the outer surface rotating about a rotational axis in a first direction and configured to convey a sheet product that has a first surface and a second surface, the first surface of the sheet product being in contact with a portion of the outer surface of the rotatable drum portion, the inner surface defining a cavity within the rotatable drum portion, and (iii) a plurality of ports communicative between the inner surface and the outer surface, the plurality of ports extending (1) from the first end to the second end of the rotatable drum portion, and (2) around at least a portion of the outer surface of the rotatable drum portion; and (b) a fluid emission portion disposed in the cavity, the fluid emission portion having (i) an orifice operative to receive a first pressurized fluid from a pressurized fluid source and (ii) a port connected to the orifice and operative to emit the first pressurized fluid through the plurality of ports of the rotatable drum portion, the port being arranged as an elongated slot in the fluid emission portion that extends (1) in a direction parallel to the rotational axis of the rotatable drum portion, and (2) from the first end to the second end of the rotatable drum portion;

(B) a second rotatable roller having (i) an outer surface arranged proximate to the outer surface of the rotatable drum portion of the first rotatable roller, and (ii) a heat source portion configured to output a second pressurized fluid and to heat the second rotatable roller to dry the sheet product, the second rotatable roller being operative to rotate in a second direction that is opposite to the first direction; and (C) a gap defined between the second rotatable roller and the first rotatable roller through which the sheet product is allowed to pass, wherein the port of the fluid emission portion is configured to emit the first pressurized fluid (i) as a stream in a region proximate to the gap, (ii) at an angle relative to the second rotatable roller, (iii) to impinge on the first surface of the sheet product in the gap, (iv) to separate contact between the outer surface of the rotatable drum portion of the first rotatable roller and the sheet product, and (v) to transfer the sheet product from the first rotatable roller to the second rotatable roller, with the second surface of the sheet product being in contact with the outer surface of the second rotatable roller as the sheet product passes through the gap, and wherein the first rotatable roller is configured to only emit the first pressurized fluid through the plurality of ports extending (1) from the first end to the second end of the rotatable drum portion, and (2) around the at least a portion of the outer surface of the rotatable drum portion.

2. The system of claim 1, wherein the first pressurized fluid includes at least one of air and steam.

3. The system of claim 1, wherein the first rotatable roller and the second rotatable roller are disposed and configured to impart a compressive force on the sheet product that is allowed to pass through the gap.

4. The system of claim 1, wherein the port of the fluid emission portion defines a flow path of the first pressurized fluid in a region partially between the fluid emission portion and the rotatable drum portion.

5. The system of claim 1, wherein the port of the fluid emission portion is stationary.

6. The system of claim 1, further including an adhesive spray assembly operative to spray an adhesive on an exposed portion of the outer surface of the second rotatable roller.

7. The system of claim 6, wherein the adhesive spray assembly is positioned upstream of the gap in a rotational direction of the second rotatable roller.

8. The system of claim 7, wherein the adhesive is operative to adhere the second surface of the sheet product to the outer surface of the second rotatable roller.

9. The system of claim 1, wherein the rotatable drum portion of the first rotatable roller is tubular.

10. The system of claim 9, wherein the plurality of ports in the rotatable drum portion of the first rotatable roller extends (1) from the first end to the second end of the tubular rotatable drum portion, and (2) around the entirety of the outer surface of the tubular rotatable drum portion.

11. The system of claim 1, wherein the angle relative to the second rotatable roller is a constant angle.

12. A method of fabricating a sheet product, the method comprising:

(A) rotating a rotatable drum portion of a first roller in a first direction about a rotational axis, the rotatable drum portion having (a) a first end and a second end, (b) an outer surface and an inner surface, the inner surface defining a cavity within the rotatable drum portion, and (c) a plurality of ports communicative between the inner surface and the outer surface, the plurality of ports extending (i) from the first end to the second end of the rotatable drum portion, and (ii) around at least a portion of the outer surface of the rotatable drum portion;

(B) rotating a second roller in a second direction, the second direction being opposite to the first direction, the second roller having an outer surface;

(C) conveying a sheet product, the sheet product having a first surface and a second surface, and the sheet product being conveyed with the first surface of the sheet product in contact with a portion of the outer surface of the rotatable drum portion of the first roller;

(D) passing the sheet product, through a gap defined between the outer surface of the first roller and the outer surface of the second roller;

(E) supplying a first pressurized fluid from a pressurized fluid source to a fluid emission portion disposed in the cavity of the first roller, the first pressurized fluid being supplied to an orifice of the fluid emission portion;

(F) emitting a stream of the first pressurized fluid from a port of the fluid emission portion of the first roller through the plurality of ports of the rotatable drum portion of the first roller, such that the stream of the first pressurized fluid (a) is emitted in a region proximate to the gap, (b) is emitted at an angle relative to the second roller, (c) impinges on the first surface of the sheet product in the gap, (d) imparts a force on the sheet product to separate contact of the sheet product from the outer surface of the rotatable drum portion of the first roller, and (e) transfers the sheet product from the first roller to the second roller, with the second surface of the sheet product being in contact with the outer surface of the second roller as the sheet product passes through the gap, the port of the fluid emission portion being connected to the orifice and arranged as an elongated slot in the fluid emission portion that extends (i) in a direction parallel to the rotational axis of the rotatable drum portion, and (ii) from the first end to the second end of the rotatable drum portion; and (G) heating the second roller with a second pressurized fluid to dry the sheet product, wherein the first roller is configured to only emit the first pressurized fluid through the plurality of ports extending (1) from the first end to the second end of the rotatable drum portion, and (2) around the at least a portion of the outer surface of the rotatable drum portion.

13. The method of claim 12, wherein the first pressurized fluid includes at least one of air and steam.

14. The method of claim 12, further comprising imparting a compressive force on the sheet product when the sheet product is passed through the gap.

15. The method of claim 14, wherein the compressive force is imparted by the first roller and the second roller.

16. The method of claim 12, further comprising spraying an adhesive on an exposed portion of the outer surface of the second roller.

17. The method of claim 16, further comprising adhering the second surface of the sheet product to the outer surface of the second roller with the adhesive.

18. The method of claim 12, wherein the rotatable drum portion of the first roller is tubular.

19. The method of claim 18, wherein the plurality of ports in the rotatable drum portion of the first roller extends (i) from the first end to the second end of the tubular rotatable drum portion, and (ii) around the entirety of the outer surface of the tubular rotatable drum portion.

20. The method of claim 12, wherein the angle relative to the second roller is a constant angle.

* * * * *